United States Patent [19]

Smaling

[11] Patent Number: 5,009,633

[45] Date of Patent: Apr. 23, 1991

[54] METHOD OF MANUFACTURING AN OUTER VACUUM CLEANER BAG FOR AN UPRIGHT CLEANER

[75] Inventor: Oral M. Smaling, Bloomington, Ill.

[73] Assignee: White Consolidated Industires, Inc., Cleveland, Ohio

[21] Appl. No.: 402,647

[22] Filed: Sep. 5, 1989

[51] Int. Cl.[5] ..... B31B 23/68; B31B 23/90

[52] U.S. Cl. ..... 493/214; 493/381; 493/927; 493/935; 493/941; 156/66

[58] Field of Search ..... 493/213, 214, 215, 381, 493/927, 935, 941; 156/66

[56] References Cited

U.S. PATENT DOCUMENTS

| | | | |
|---|---|---|---|
| 3,283,672 | 11/1966 | Mueller | 493/214 |
| 4,355,494 | 10/1982 | Tilman | 493/214 |
| 4,415,386 | 11/1983 | Ferrell et al. | 156/64 |
| 4,601,694 | 7/1986 | Ausnit | 493/214 |
| 4,812,074 | 3/1989 | Ausnit et al. | 493/213 |
| 4,892,512 | 1/1990 | Branson | 493/194 |

*Primary Examiner*—William E. Terrell

*Attorney, Agent, or Firm*—Pearne, Gordon, McCoy & Granger

[57] ABSTRACT

A method of manufacturing the outer cloth bag for an upright vacuum cleaner in which the bag material of a predetermined width is unwound from a reel an fed through guides, material folders and a double headed sewing machine. At the same time zipper chains are fed from rolls on the right and left side of the moving bag material. The zippers are sewn on opposite side edges of the bag, the bag material is cut into predetermined sized panels, and thereafter the side edges of the panels are folded and the zipper halves zipped up to form a tube. At least one open end is closed to form a bag.

7 Claims, 1 Drawing Sheet

METHOD OF MANUFACTURING AN OUTER VACUUM CLEANER BAG FOR AN UPRIGHT CLEANER

The present invention relates to a method of manufacturing an outer bag for an upright vacuum cleaner on an automatic assembly line whereby bag material, as well as zipper material, both in continuous rolls are fed into an assembly line wherein zipper lengths are sewn on opposite sides of the bag material, and the assembled product is cut in predetermined lengths whereby the separated bag is zipped together to form a tube. The tube is enclosed at one or both ends to form a finished upright vacuum cleaner outer bag assembly.

The prior art method of manufacturing an outer bag is performed by either cutting the bag material to specified sizes and shapes, and attaching a finished assembled zipper to the sides of the cut panel by sewing or dielectric sealing means thereby forming a tube to be closed on one or both ends. Another method of manufacturing an outer bag for an upright vacuum cleaner is to cut the bag material into panels of specified sizes and shapes. Thereafter, one half of the zipper is attached to opposite sides of the panel by sewing or dielectric sealing methods. Then the sides with the zipper halves attached are zipped together causing the assembly to form a tube to be closed on one or both ends to form a bag.

Either of the above prior art methods of manufacturing an outer bag with a zipper for an upright vacuum cleaner is slow and time consuming. Consequently, the present invention, which automatically feeds both bag and zipper material in long rolls, whereby a high speed production of vacuum cleaner outer bags with zipper-type openings is accomplished. The present method of manufacturing vacuum cleaner outer bags includes the use of a double headed sewing machine to sew the left and right side zippers thereon simultaneously. Thereafter, the assembled product is then fed into a cutting press with an automatic incremental feed system which cuts the bottom of one panel and the top of the succeeding panel to specified lengths and constitutes a marked improvement over the methods practiced by the prior art.

In order that the invention may be more clearly understood, it will be disclosed in greater detail with reference to the accompanying figures of the drawings, wherein:

FIG. 1 is a diagram-matic view of the present method showing the steps thereof in sequence and FIG. 2 is a top plan view of the diagram of FIG. 1.

DESCRIPTION OF THE PREFERRED EMBODIMENTS

Figure 1:
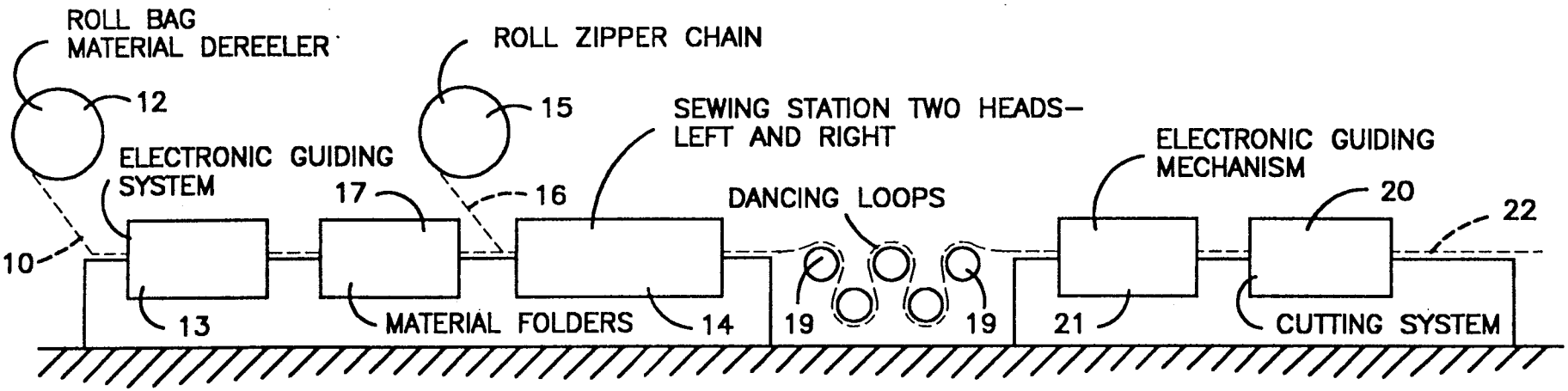
Figure 2:
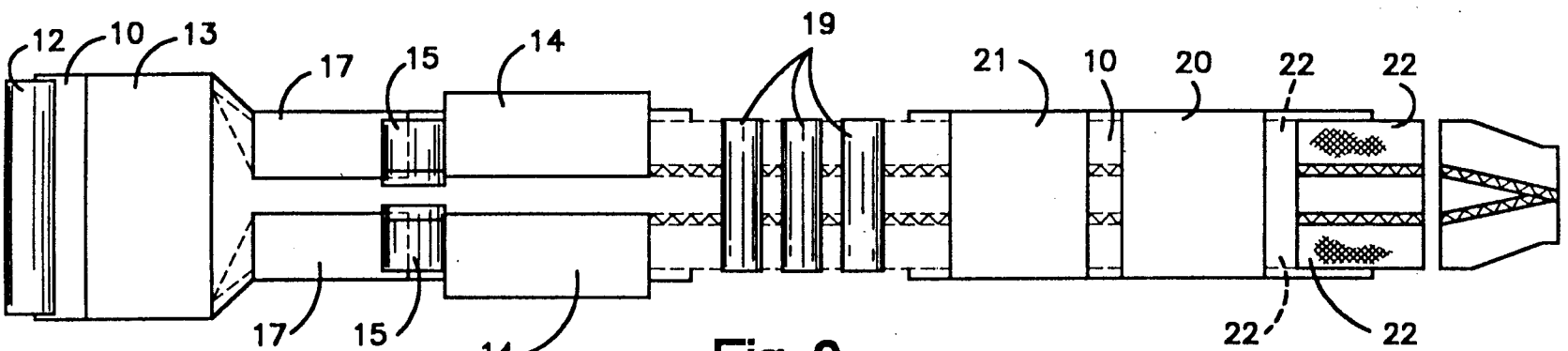

Referring particularly to the FIGS. 1 and 2 of the drawings, the outer bag material 10 for an upright vacuum cleaner is fed from a roll 12 through an electronic guiding system 13. The material 10 is of a specified width and on each side of the roll 12 are rolls 15 of zipper material 16 with the left half of the zipper **16*a* being fed simultaneously with the bag material on the left side of the bag material 10, while the right half of the zipper 16*b* is fed simultaneously on the right side of the bag material. The bag material 10 is then fed into a folding device 17 on each side thereof which folds over the edges 10*a* of the material with the left on the left side, the right on the right side. The bag material 10 and the zipper halves are then passed into an automatic double-headed sewing machine 14. The assembled product is then fed through a series of dancing loops 19 and through electronic guiding mechanism 21 and finally into a cutting press 20 by mean of an automatic incremental feed system in the electronic guiding mechanism. The cutting press 21 which cuts the assembled product into specified lengths and shaped panels 22**. Thus, each stroke of the cutting press of the cutting system cuts the bottom of one panel P and the top of the next panel Pl. Consequently, the panel with the zipper halves on each side are then zipped together forming a tube. Finally, the tube can be selectively closed on one or both ends to form a bag.

The present invention is directed to an automatic highspeed manufacturing method for fabricating outer vacuum cleaner bags for upright cleaners which substantially increases production without a decrease in quality.

While the present invention has been disclosed and described herein with reference to a certain method, it is apparent that variations and modifications may be made which will fall within the true spirit and scope of the invention as defined in the following claims.

What we claim is:

1. A method of manufacturing an outer vacuum cleaner bag for a vacuum cleaner, comprising the steps of:

drawing out vacuum cleaner bag material cut to a specified width from a roll, the bag material having left and right sides, each having a side edge;

folding the side edges of the bag material;

providing zipper halves on the right and left sides of the bag material;

feeding the bag material into a double-headed sewing machine with each of the heads on the sewing machine engaging one of the sides of the bag material;

feeding each of the zipper halves into the respective head of the sewing machine and sewing the zipper halves on the right and left hand side edges of the bag material to form a bag assembly; and feeding the bag assembly into a cutting press using an automatic incremental feed apparatus whereby the bag material is cut into panels.

2. A method of manufacturing an outer vacuum cleaner bag as claimed in claim 1 wherein each stroke of the cutting press cuts the bottom of one panel and the top of the succeeding panel.

3. A method of manufacturing an outer vacuum cleaner bas as claimed in claim 1, comprising the additional steps of zipping the zipper halves together to form a tube, and closing at least one end of the tube to form a bag after the zipper halves are sewn on the right and left sides of the bag material, respectively, and after the bag material is cut into panels.

4. A method of manufacturing an outer vacuum cleaner bag as claimed in claim 1, comprising the additional step of feeding the folded sides edges of the bag material and the zipper halves through guides in the sewing heads of the double-headed sewing of the zipper halves on their respective sides of the bag material.

5. A method of manufacturing an outer vacuum cleaner bag as claimed in claim 1, comprising the additional step of feeding the bag material through a guidance arrangement prior to folding the side edges of the bag material.

6. A method of manufacturing an outer vacuum cleaner bag as claimed in claim 5, comprising the additional step of feeding the bag material through an additional guidance arrangement prior to cutting the bag material into panels.

7. A method of manufacturing an outer vacuum cleaner bag as claimed in claim 6, wherein the bag material is fed through an additional guidance arrangement that is electronic.

* * * * *

UNITED STATES PATENT AND TRADEMARK OFFICE

CERTIFICATE OF CORRECTION

PATENT NO. : 5,009,633

DATED : April 23, 1991

INVENTOR(S) : Oral M. Smaling

It is certified that error appears in the above-identified patent and that said Letters Patent is hereby corrected as shown below:

Col. 2, line 60, after "sewing" (second occurrence) insert --machine prior to sewing--.

Signed and Sealed this

Fifteenth Day of September, 1992

*Attest:*

DOUGLAS B. COMER

*Attesting Officer*

*Acting Commissioner of Patents and Trademarks*